United States Patent [19]

Eddins et al.

[11] 4,249,733

[45] Feb. 10, 1981

[54] TOY RACEWAY

[75] Inventors: Fred D. Eddins, Mapleville, R.I.; Sidney Tepper, Millburn, N.J.

[73] Assignee: Hasbro Industries, Inc., Pawtucket, R.I.

[21] Appl. No.: 17,696

[22] Filed: Mar. 5, 1979

[51] Int. Cl.[3] ..... A63F 9/14

[52] U.S. Cl. ..... 273/86 C; 46/206; 104/79

[58] Field of Search ..... 273/86 C; 46/202, 261, 46/43, 206; 104/55, 56, 58, 79, 164

[56] References Cited

U.S. PATENT DOCUMENTS

| | | | |
|---|---|---|---|
| 793,471 | 6/1905 | Thomas et al. | 273/86 C UX |
| 1,515,533 | 11/1924 | Willis | 104/55 |
| 1,715,891 | 6/1929 | Beck | 104/79 |
| 3,514,108 | 5/1970 | Tepper et al. | 104/60 |
| 3,540,153 | 11/1970 | Aoki | 46/261 |

*Primary Examiner*—Anton O. Oechsle
*Attorney, Agent, or Firm*—Salter & Michaelson

[57] ABSTRACT

A racing toy including a pair of side-by-side main tracks defining down-hill paths for a pair of gravity operated vehicles. The opposite ends of each track are spaced from each other and a pair of pivotal ramps are disposed in such space so as to in effect interconnect such ends. Each ramp has a vehicle receiving portion at one end and an angularly disposed launching portion and is pivotally supported adjacent the initial elevated end of its respective main track. The ramp may be alternatively moved from a lowermost vehicle receiving position to an elevated vehicle launching position so as to in effect form continuous closed loop trackways around which the vehicles may cycle a desired number of turns. The means for elevating the ramps include outwardly projecting handles for the participants of the toy to appropriately manipulate the respective vehicles across the space defined by the track ends.

7 Claims, 6 Drawing Figures

TOY RACEWAY

BACKGROUND AND SUMMARY OF THE INVENTION

This invention relates to racing toys of the type in which gravity rollable vehicles such as toy cars are adapted to move around continuous tracks. More particularly, the invention relates to such toys wherein each track is inclined in one direction to define a downhill path along which the vehicle can roll and a ramp forming a discontinuity in the track at the lower terminal end of its path wherein the vehicle may again be elevated to the upper portion of the path and recycled the desired number of times by the children playing with the toy.

Some toys of this general type operate on the principle that the vehicles are automatically returned from the lower point in the downhill path to the upper point thereof. This reduces to some extent the player interest in the toys since it primarily forms a passive game wherein each child is merely an observer. An example of a toy of this general type is shown in U.S. Pat. No. 1,551,002 issued Aug. 25, 1925 wherein a motor operated gear train is utilized to elevate the vehicle from its lowermost position to a higher restart position by means of a pivotal connecting ramp. The ramp is maintained in its lower position by a locking device which is automatically released when contacted by the vehicle.

A further example of a toy of this general type is shown in U.S. Pat. No. 3,514,108 issued May 26, 1970 wherein side-by-side tracks are provided such that toy vehicles may race as by gravity along downhill paths. The tracks include an uphill track portion connecting the terminal downhill point with the elevated starting point. When the vehicles reach the end of the downhill track, they are engaged by a pawl which may continuously move beneath the surface of the uphill track portion separately by manipulation by each of the player participants. While such construction enables a more direct participation of the players, the means by which the vehicles are moved uphill to their starting position is primarily concealed and of a controlled mechanical nature.

The present applicants believe that the play value and excitement of a racing toy of this general type could be further enhanced if the manner in which the vehicles are elevated to their restarting positions is dependent even more upon the skill and dexterity of the individual player participants rather than upon a more mechanical function. Accordingly, it is a primary object of the present invention to provide a racing toy of the general type above described in which the player participants actively utilize an enhanced degree of eye-hand coordination in order to competitively elevate their individual vehicles to the restarting points so as to enable the vehicles to recycle along the "in effect" continuous trackway formed by the device.

A further object of the present invention is to provide a device of the aforementioned type in which a positive stop is formed at the downhill portion of the vehicle path, which stop is an integral part of the ramp and accordingly does not require separate components.

A still further object of the present invention is the provision of a racing toy as set forth in the immediate preceding objects in which positive means are provided for retaining the vehicle on the upper surface of the ramp when such ramp is elevated to an upper position so as to in effect initiate a restarting or recycling of the vehicle about the trackway.

These and other objects of the present invention are accomplished by a racing toy having a pair of equal length, downhill tracks, the ends of which are spaced from each other and in effect interconnected by pivotally elevating ramps. Each of the ramps includes a vehicle receiving portion positioned proximal the end of the downhill path and a vehicle launching portion proximal to the elevated starting point of the main track. The aforementioned portions define an obtuse angle of less than 180° between each other such that a segment of the launching ramp portion adjacent the vehicle receiving portion forms a positive stop for the vehicle. In addition, positive means for retaining the vehicle on the upper surface of the ramp while elevating the ramp are provided such that relatively quick pivotal motions of the ramp will not cause the vehicle to leave the ramp surface. The pivotal elevational movement of the ramps is provided by separate elevation means including separate player movable handles operationally connected to lever mechanisms for separately elevating the respective ramps.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE INVENTION

Figure 1:
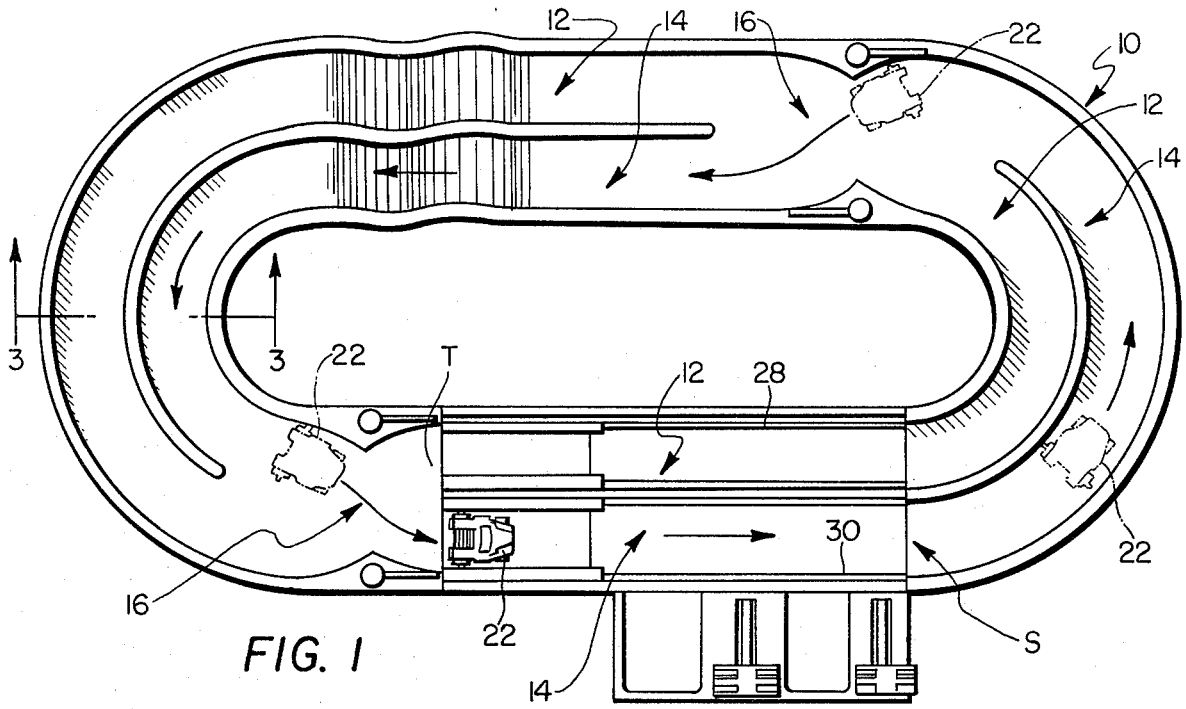
FIG. 1 is a plan view of the racing toy of the present invention showing in particular the manner in which the length of the vehicle paths are formed and equalized so that vehicles may be continuously cycled therearound.
Figure 2:
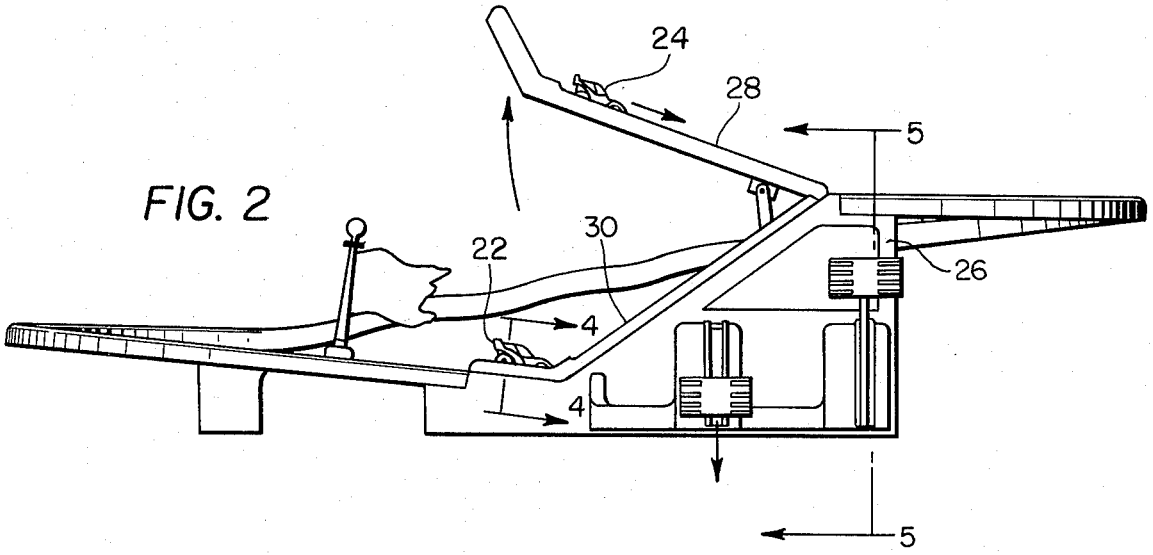
FIG. 2 is a side elevational view of FIG. 1 showing one of the track connecting ramps in a lower vehicle receiving position and the other in an upward vehicle launching position.
Figure 3:
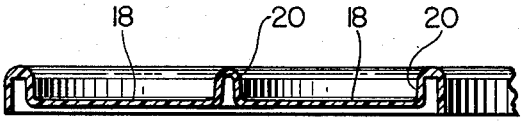
FIG. 3 is a sectional view along the lines 3—3 of FIG. 1 showing a portion of the main track.
Figure 4:
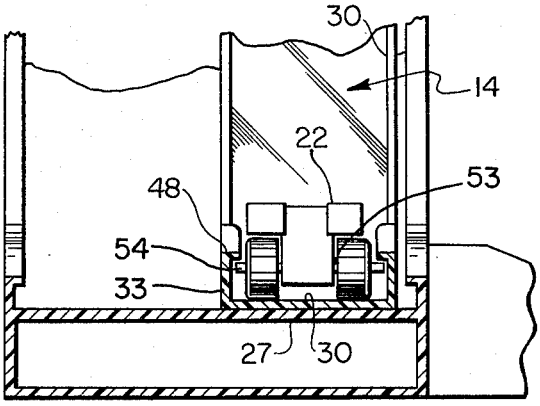
FIG. 4 is a sectional view taken along the line 4—4 of FIG. 2 and shows in particular the manner in which the vehicles may be positively retained on the upper surface of the ramp even while such ramp is being elevated to its upper position.

Turning to the drawings and particularly FIGS. 1 and 2, the overall configuration of the racing toy 10 of the present invention is shown as including a pair of side-by-side tracks 12 and 14 which include an even number of cross-over areas 16 such that the travel length of each track is equal. While the tracks are shown of generally oval configuration it should be apparent that any configuration may be utilized. Similarly, although two tracks are illustrated, it should be apparent as many as desired may be utilized and in some forms of the invention a single track may be used. Generally, the tracks 12 and 14 are formed from molded plastic material and include a bottom wall having an upper vehicle receiving surface 18 and upwardly extending laterally disposed sidewalls 20 which serve to laterally confine the vehicles 22 and 24 as they move by gravity along their respective paths.

The main tracks 12 and 14 are supported by a frame 26 such that the starting point S of the vehicle paths is substantially elevated from the terminal point T thereof. The respective starting and terminal ends of the tracks 12 and 14 are additionally longitudinally spaced from each other. The tracks are thus "in effect" discontinuous; however, such space is filled by a pair of ramps 28 and 30 which serve to interconnect the terminal and starting ends of the main tracks 12 and 14 respectively in a manner which will hereinafter be more fully apparent. The ramps 28, 30, each include a base or vehicle supporting surface 32 and a pair of opposed spaced side walls 33 upstanding from such base.

Each ramp further includes a vehicle receiving portion 34 and a vehicle launching portion 36, which portions are angularly disposed to each other so as to define an obtuse angle (a) of less than 180 degrees. That end of the ramp launching portion 36 distal from the vehicle receiving portion 34 is provided with a laterally extending ear 38 having an opening 40 therethrough for receipt of a pin 42. The pin is mounted at opposite ends thereof in bearing supports 44 which are in turn supported by the frame 26. Inasmuch as the ramps 28 and 30 are aligned side by side, a single pin 42 serves to pivotly connect both ramps to the frame 26. The pivot point for the ramps 28, 30 is thus disposed adjacent the starting points of the main tracks 12 and 14.

Figure 6:
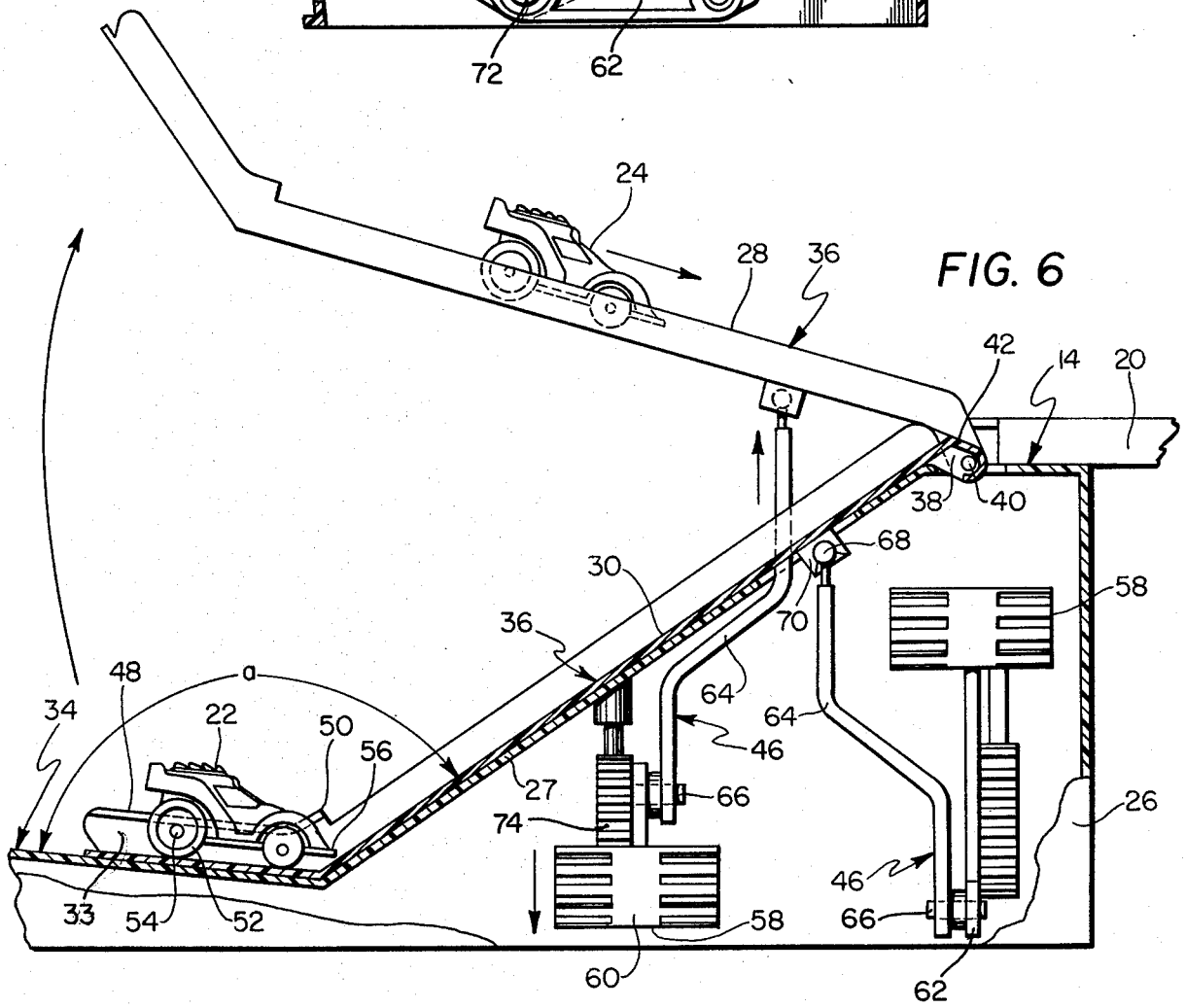

Separate ramp elevation assemblies 46 are disposed side by side and are adapted to elevate each of the ramps 28 and 30 from a lower position wherein the car receiving portion 34 of the ramp is disposed adjacent the terminal T of the tracks 12, 14 to an elevated position. In such elevated position, the vehicle may move as by gravity away from the vehicle receiving portion 34, along the launching portion 36 and thence onto the starting sections of the main tracks 12 and 14 adjacent thereto. For example, as shown in FIG. 6 a car 22 is shown positioned on the ramp 30 at the vehicle receiving portion 34 thereof. The ramp 30 is thus in its lower position. The ramp 28 on the other hand is in an elevated or upper position such that a car 24 may move by gravity away from the vehicle receiving portion 34 and thence along the vehicle launching portion 36 of the ramp 28. Inasmuch as the forward ends of the vehicle launching portion of the ramp are adjacently disposed to the starting ends of the main tracks 12 and 14, the car 24 is cycled across the starting point S and along its associated track 12. Thereafter, the child controlling car 24 may immediately move the ramp 28 into its lower car receiving position so as to position the ramp to again receive the car after it has circled the track and thus continue the cycle. Accordingly, as may be apparent, the level of eye and hand coordination needed to appropriately position the ramp to receive the cars at the end of their downhill path and quickly elevate them so as to in effect form a continuous path in order to recycle the cars the desired number of times, enhances the play value and the competitiveness of the toy.

In order that the vehicles will not be outwardly projected from the upper surface of the ramps when the ramps are moved to the elevated position (such action may be done quite rapidly and accordingly build up momentum in the cars), the vehicle receiving portion 34 of each ramp is provided with a positive retaining means including a wall 48 inwardly extending from each of the ramp sidewalls 33 so as to overhang the vehicle supporting surface 32 thereof at a position spaced upwardly therefrom. The wall 48 roughly parallels ramp surface 32 until it is adjacent the angular connection between the respective vehicle receiving and the vehicle launching portions 34 and 36 of each of the ramps, at which point the wall 48 terminates in an upwardly flared portion 50 so as to increase the space between such wall and the ramp surface 32.

Each of the vehicles includes rear wheels 52 supported upon an axle 53, which axle includes terminal segments 54 which outwardly extend from the sides of the car so as to project beneath and generally adjacent to the lower surfaces of the opposed walls 48. In this regard, when either of the ramps is swung from its lower to its elevated position, the momentum imparted to the cars when the ramps reach their uppermost point will be restrained by the axle segments 54 contacting the walls 48 so as to prevent the cars from flying off the upper surface of the ramps.

Each of the cars is also provided with a forwardly projecting bumper 56 which is adapted to contact the portion of car launching section 36 which is proximal to car receiving portion 34 of the ramp and thus provide a positive stop for the car as it enters the ramp from the terminal section of its downhill path. The elevation of the ramp to its upper position initiates a gravitional force upon the car which enables it to overcome the frictional contact between the bumper 56 and the surface 32 of the car launching portion 36 which is in contact with such, so as to enable the car to move downwardly along the launching section 36 as is shown by car 24 of FIG. 6. In this regard the increased vertical spacing between the axle segments 54 and the wall 48 at the outwardly flared portion 50 thereof enables the car to move past the wall 48 and no longer be restrained thereby.

Figure 5:
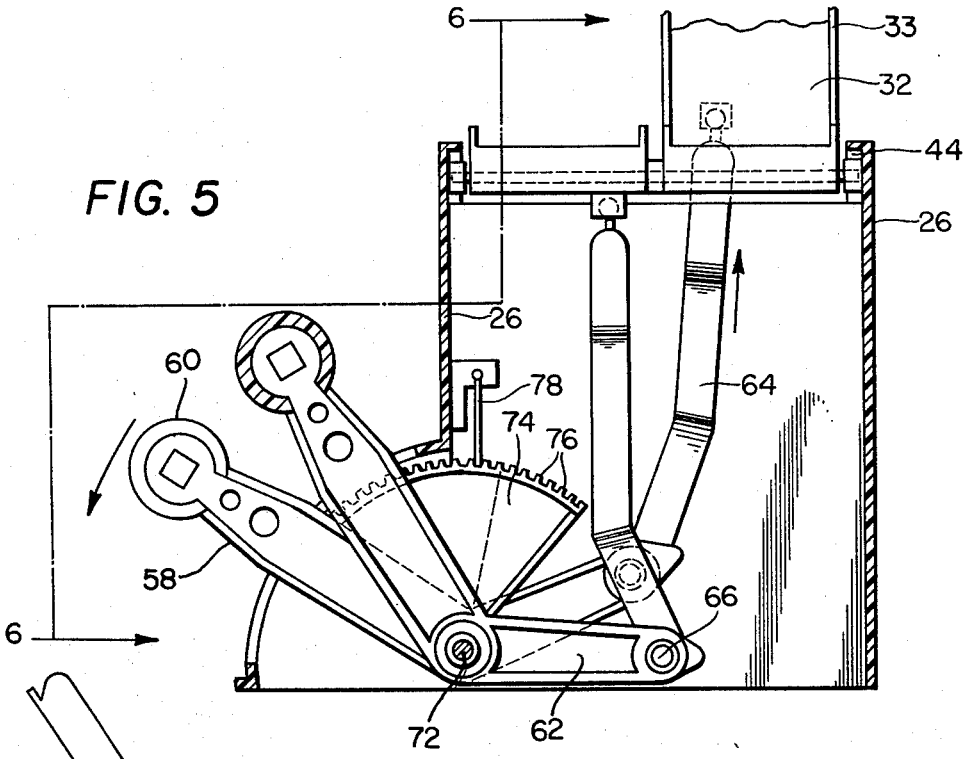
FIG. 5 is a sectional view along the line 5—5 of FIG. 2 and shows in particular the ramp elevation means and, FIG. 6 is an elevation view taken along line 6—6 of FIG. 5 on an enlarged scale and illustrating in particular the manner in which a ramp may be moved from a vehicle receiving to a vehicle launching position.

Turning now to FIGS. 5 and 6 particularly, the elevation assemblies 46 whereby the ramps 28 and 30 are moved between their upper and lower positions is best illustrated. The elevation assemblies 46 are disposed in side by side spaced relationship to each other and include operational handles 58 which outwardly project from a position below and adjacent the ramps 28 and 30. The handles 58 are additionally generally disposed at right angles to the sides of the ramps. The handles 58 include a grasping knob 60 whereby the child may grasp and accordingly manipulate the handles back and forth so as to elevate and lower the ramps. Additionally, the handles include an offset connecting arm 62 which in turn terminate in a pivotal connection with an upright push link 64 by means of an appropriately supported pin 66. The other end of the push link 64 includes a headed member 68 adapted for receipt within a socket 70 downwardly projecting from the lower surface of each of the ramps 28 and 30. Additionally, the handles 58 are supported from the frame 26 in any known manner as at intermediate points along an axis pin 72 for limited pivotal movement thereabout and thus may alternatively drive the push link 64 upwardly and downwardly via the aforementioned lever mechanisms.

In addition, each of the handles 58 is provided with a pie-shaped segment 74 laterally offset therefrom and disposed in side-to-side relation with each other. The arcuate upper end of each segment 74 includes a plurality of teeth 76 which are adapted to mesh with a somewhat flexible downwardly extended rod 78 suitably connected to the frame 26 by any suitable means. The interconnection between the rod 78 and the teeth 76 enables the handles 58 to be retained in whatever position they are moved to by the player participants, although this retaining relationship may easily be overcome by forceably moving the handle upwardly or downwardly, as depicted.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A racing toy comprising, a raceway including at least one main track having an elevated initial end portion and a lower terminal end portion so as to define a downhill path and at least one gravity operated vehicle for movement along said path, said main track ends spaced from each other and a pivotally mounted connecting ramp disposed between said main track ends in said space therebetween, said pivotal connecting ramp having a first vehicle receiving portion and an adjacent second vehicle launching portion, said vehicle receiving portion proximal the terminal end of said main track and forming a continuation thereof when said ramp is in a lower vehicle receiving position, means for manually pivotally elevating said ramp from its lower vehicle receiving position to an upper vehicle launching position wherein said ramp is elevated above said initial end of said main track, and positive retaining means for retaining said vehicle on the upper surface of said ramp while elevating said ramp, said connecting ramp having an intermediate angular bend defining an included obtuse angle of less than 180° and delineating said vehicle receiving and vehicle launching portions from each other on opposite sides of said bend and wherein said receiving portion forms a downwardly slanted continuation of said main track terminal end when said ramp is in its lower position, and said launching portion proximal to said receiving portion is adapted to contact a forward portion of said vehicle so as to position said vehicle on said vehicle receiving portion of said ramp when said ramp is in its lower position and during its elevation to its upper position whereupon such repositioning of said receiving portion enables said vehicle forward portions to move past and out of contact with said proximal launching portion.

2. The toy of claim 1, said vehicle being an axle supported wheeled vehicle with laterally extending axle segments, said positive retaining means comprising laterally spaced walls overhanging said ramp vehicle receiving portion and adapted to overlie and engage said extending axle segments, said vehicle adapted to roll by gravity past said upper retaining means on to the surface of said vehicle ramp launching portion.

3. The toy of claim 2, said walls spaced above and generally parallel to said ramp vehicle receiving portion and terminating in upwardly flared portions generally adjacent said angular bend and spaced above said ramp vehicle launching portion at a greater height than the spacing of the major extent of said walls above said ramp vehicle receiving portion.

4. The toy of claim 1, said elevation means including a handle adapted for grasping by a child playing with the toy, lever means connecting said handle to said ramp whereby operation of said handle causes said ramp to alternatively move between its vehicle receiving and vehicle launching positions, said raceway having two side by side equal length main tracks, each said track having a connecting ramp associated therewith, separate handles outwardly projecting from said ramps in a position generally transversally disposed thereto and in turn connected to separate elevating means for each of said ramps, said handles operable by child players separately operating said ramps so as to enable said vehicles to cycle its respective downhill path a selected number of times.

5. The toy of claim 4, each of said lever means including a push link connected at one end to said ramp and pivotally connected at the other end thereof to said handle, the pivot point of each of said ramps being adjacent said elevated initial end of its respective said main track, said push link connected to said ramp proximal said pivot point thereof.

6. The toy of claim 1, said forward portion of said vehicle being a forwardly projecting bumper adapted to contact said proximal launching portion.

7. A racing toy comprising, a raceway including at least one main track having an elevated initial end portion and a lower terminal end portion so as to define a downhill path and at least one gravity operated vehicle for movement along said path, said main track ends spaced from each other and a pivotally mounted connecting ramp disposed between said main track ends in said space therebetween, said pivotal connecting ramp having a first vehicle receiving portion and an adjacent second vehicle launching portion, said vehicle receiving portion proximal the terminal end of said main track and forming a continuation thereof when said ramp is in a lower vehicle receiving position, means for manually pivotally elevating said ramp from its lower vehicle receiving position to an upper vehicle launching position wherein said ramp is elevated above said initial end of said main track, and positive retaining means for retaining said vehicle on the upper surface of said ramp while elevating said ramp, said raceway having two side by side equal length main tracks, each said track having a connecting ramp associated therewith, separate handles outwardly projecting from said ramps in a position generally transversally disposed thereto and in turn connected to separate elevating means for each of said ramps, said handles operable by child players separately operating said ramps so as to enable said vehicles to cycle its respective downhill path a selected number of times.

* * * * *